US005276419A

United States Patent [19]

Griffin et al.

[11] Patent Number: 5,276,419

[45] Date of Patent: Jan. 4, 1994

[54] AIR-CODE MAGNETIC FLUX GUIDE

[75] Inventors: Joseph T. Griffin, Charolotte, N.C.; Steven M. Iden, Belvidere, Ill.

[73] Assignee: The United States of America as represented by the Secretary of the Air Force, Washington, D.C.

[21] Appl. No.: 846,492

[22] Filed: Feb. 18, 1992

[51] Int. Cl.[5] ..... H01F 7/22

[52] U.S. Cl. ..... 335/216; 335/301; 335/304

[58] Field of Search ..... 335/216; 505/704, 872

[56] References Cited

U.S. PATENT DOCUMENTS

| | | | |
|---|---|---|---|
| 3,317,286 | 5/1967 | Sorbo | 29/183.5 |
| 3,331,041 | 7/1967 | Bogner | 335/216 |
| 3,378,691 | 4/1968 | Swartz | 307/91 |
| 4,409,579 | 10/1983 | Clem et al. | 335/216 |

FOREIGN PATENT DOCUMENTS

| | | | |
|---|---|---|---|
| 0337709 | 4/1989 | European Pat. Off. | 335/216 |
| 0296207 | 5/1987 | Japan | 335/216 |
| 0010808 | 6/1988 | Japan | 335/216 |
| 1143309 | 6/1989 | Japan | 335/216 |
| 0207908 | 8/1989 | Japan | 335/216 |
| 0060108 | 2/1990 | Japan | 335/216 |

*Primary Examiner*—Leo P. Picard
*Assistant Examiner*—Stephen Ryan
*Attorney, Agent, or Firm*—Bernard E. Franz; Thomas L. Kundert

[57] ABSTRACT

A device to guide, shape, contain, or concentrate magnetic flux comprises a tube or conduit made of superconducting material to constrain the path of magnetic flux and guide it to a target volume. Below the transition point the material exhibits no resistance to electrical current flow and is impermeable to magnetic flux. In one embodiment, the superconducting material is configured into a cylindrical tube. Upon entrance into the tube the magnetic flux generated by a magnet is constrained to remain between the walls of the tube until it exits the open end where the flux passes through a target volume. In another embodiment, the magnet is situated between two hollow U-shaped arms of superconducting material. The target is situated between the opposite arms of the superconducting material. Magnetic flux generated by the magnet is confined within the U-shaped arms of the superconducting material and passes through the target volume.

1 Claim, 5 Drawing Sheets

$\vec{B}$ = MAGNETIC FLUX DENSITY $$(\sigma_o) = (\sigma_i)$$

$$|\vec{B}_o| \times A_o = |\vec{B}_i| \times A_i$$

$$|\vec{B}_o| = \frac{A_i}{A_o} |\vec{B}_i| \quad \text{if } B_o < \text{SATURATION}$$

$$\left|\vec{B}_o\right| = \frac{A_i}{A_o}\left|\vec{B}_i\right|$$

AIR-CODE MAGNETIC FLUX GUIDE

RIGHTS OF THE GOVERNMENT

The invention described herein may be manufactured and used by or for the Government of the United States for all governmental purposes without the payment of any royalty.

BACKGROUND OF THE INVENTION

The present invention relates generally to an air-core magnetic flux guide.

In free space, flux lines from a magnet (either permanent magnet or electromagnet) diverge after leaving a pole, as shown in FIG. 1. The magnet must therefore be located close to a target volume (a volume of space through which passage of the magnetic flux is desired) if significant flux is to pass through this volume.

It may be desirable to locate the magnet away from the target volume. Currently, a solid rod of ferromagnetic (high permeability) material may be used to guide flux to a target volume remote from the magnet, as in FIG. 2*a*. Another configuration is shown in FIG. 2*b*. The high permeability of the ferromagnetic material compared to free space provides a low reluctance path for the magnetic flux. The flux therefore tends to follow this path, in order to bring the system to the lowest energy state. A percentage of flux will take a free space path as leakage flux. There will also be fringing flux at sharp edges and other discontinuities.

Flux may also be concentrated by using a high permeability material. FIG. 2*c* illustrates this concept to demonstrate the principles involved. In accordance with Ampere's Law, the flux into a node must be equal to the flux out of that node. A reduction in cross-sectional area of a ferromagnetic medium will cause a proportional increase in magnetic flux density, at low flux density levels. This a commonly practiced technique for designing magnetic pole faces and will work until saturation of the ferromagnetic material is approached (typically around two Tesla).

One disadvantage of using ferromagnetic material in these applications is the large mass of the ferromagnetic flux guide. A further disadvantage is the leakage flux, which can cause interference with other devices and instruments near the magnet and flux guides, and reduces the amount of flux passing through the target volume. A third disadvantage is the fringing effect at the ends of the flux guide, which can interfere with the uniformity of the magnetic field through the target volume. A fourth disadvantage occurs as the magnetic flux density approaches the saturation density of the ferromagnetic material. For iron, this is about two Tesla. As saturation is approached, the material's permeability decreases to the point that it is not much higher than the free space surrounding the material. Consequently, much of the flux is not constrained by the material, and seeks a free-space path as leakage flux.

The following U.S. Patents are of interest.

U.S. Pat. No. 3,317,286—Sorbo

U.S. Pat. No. 3,331,041—Bogner

U.S. Pat. No. 3,378,691—Swartz

U.S. Pat. No. 4,409,579—Clem

In particular, the Sorbo patent teaches a method of making superconductive material. The patent to Bogner teaches a superconductive device for shielding magnetic fields comprising a structure of hard superconductive material and sheet members of good heat conducting metal. The patent to Swartz teaches a method of shielding a low magnetic field from a high magnetic field by providing a plurality of concentric superconductor material around the low magnetic field. The patent to Clem teaches a device which includes a solenoid substantially extensive with and overlying the superconducting cylinder.

SUMMARY OF THE INVENTION

An objective of the invention is to provide a device to guide, shape, contain, or concentrate magnetic flux, without the disadvantages described above.

The device according to the invention comprises a tube or conduit made of superconducting material to constrain the path of magnetic flux and guide it to a target means. At the transition temperature and a certain combination of current density and flux density, called here the transition point, the superconductive material offers no resistance to electric current, and also becomes impermeable to magnetic flux. This last property allows the device to operate the material exhibits minimal resistance to electrical current flow.

In one embodiment of the invention, the superconducting material is configured into a cylindrical tube. Upon entrance into the tube the magnetic flux generated by a magnet is constrained to remain between the walls of the tube until it exits the open end where the flux passes through a target volume.

In another embodiment of the invention the magnet is situated between two hollow U-shaped arms of superconducting material. The target is situated between the opposite arms of the superconducting material. Magnetic flux generated by the magnet is confined within the U-shaped arms of the superconducting material and passes through the target volume.

DETAILED DESCRIPTION

Figure 1:
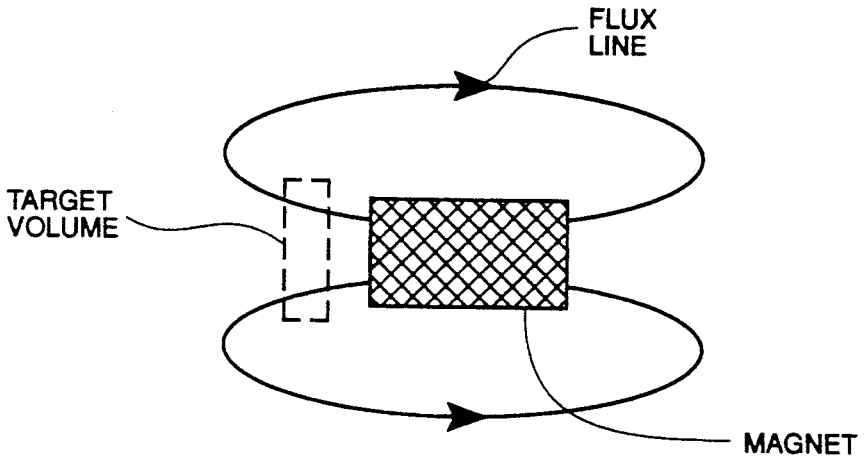
PRIOR ART Fig. 1
FIG. 1 is a prior art diagram showing a magnet and flux lines through a target volume.
Figure 2A:
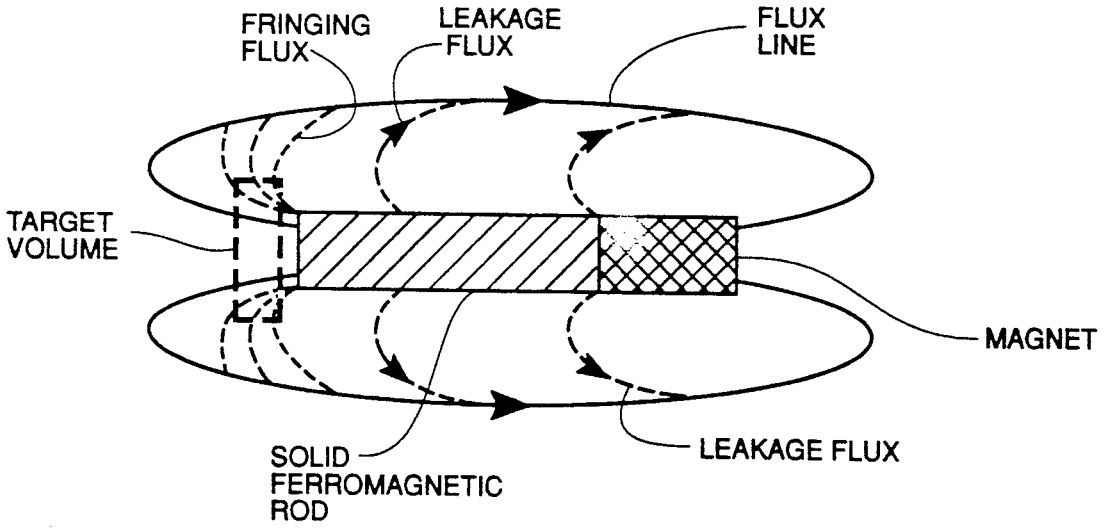
PRIOR ART Fig. 2a
FIGS. 2*a*, 2*b* and 2*c* are diagrams of prior art ferromagnetic devices for either guiding or concentrating flux through a target volume.
Figure 2B:
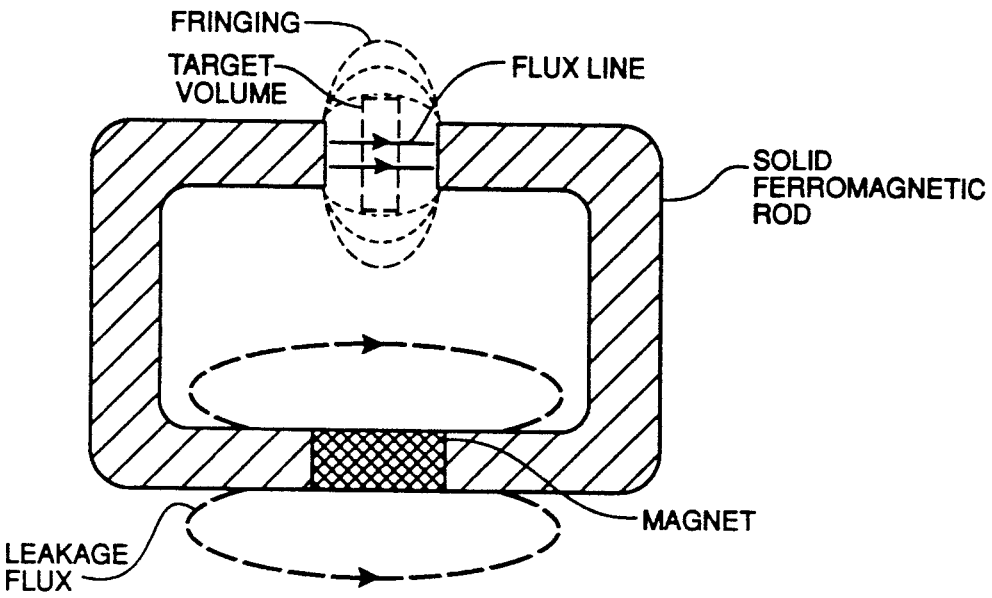
PRIOR ART Fig. 2b
Figure 2C:
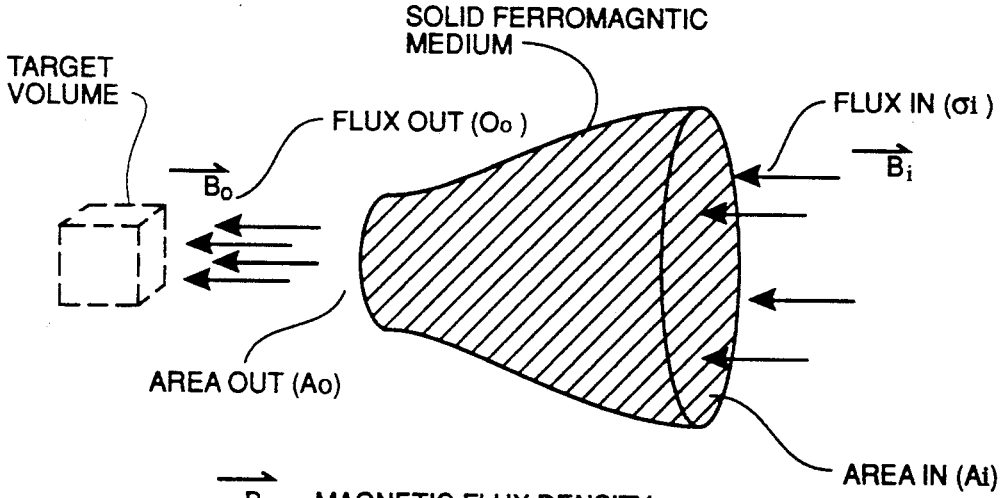
PRIOR ART Fig. 2c
Figure 3A:
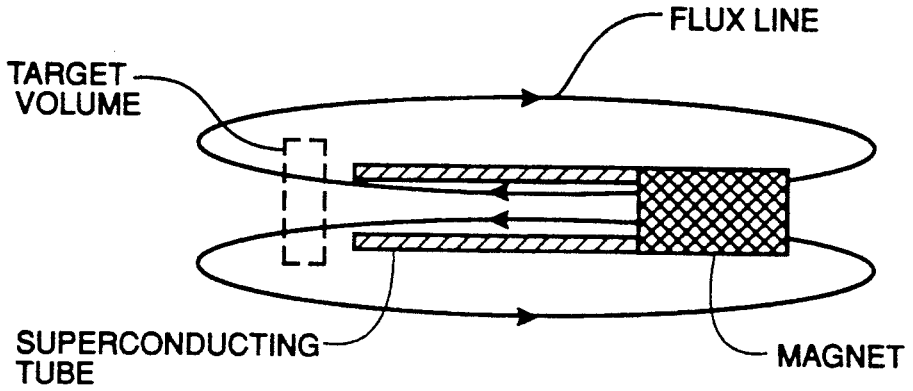
FIGS. 3*a*, 3*b* and 3*c* are diagrams of devices according to the invention using superconducting tubes for either guiding or concentrating flux through a target volume.
Figure 3B:
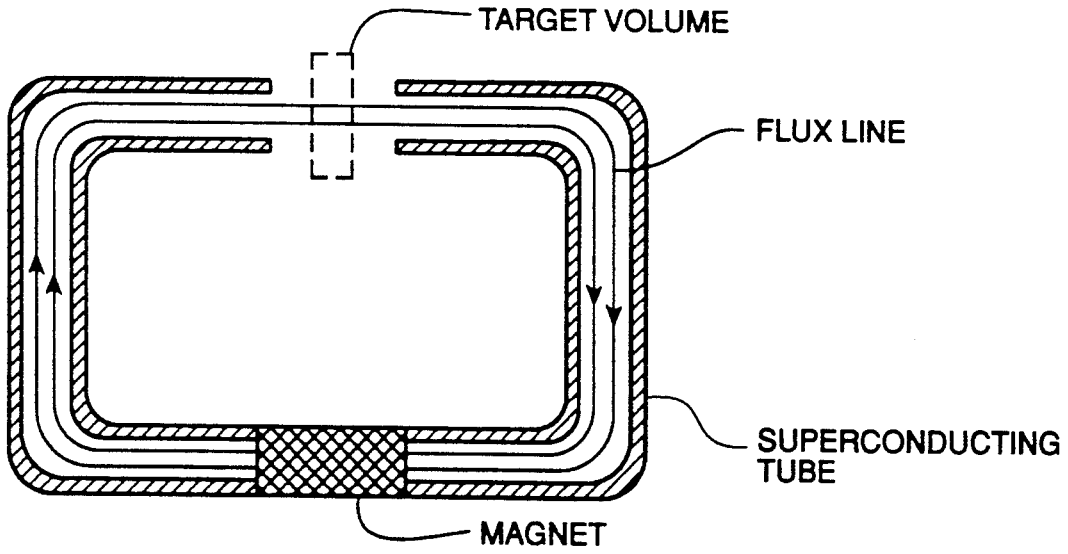
Figure 3C:
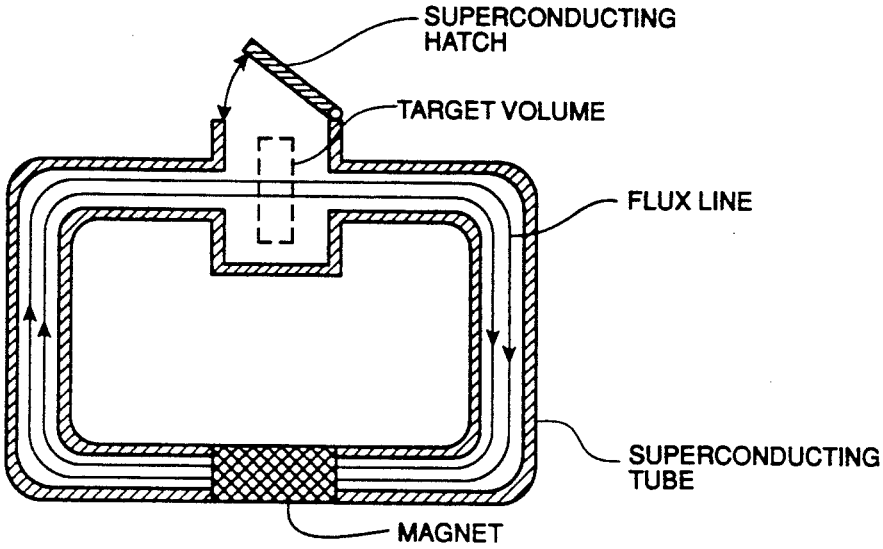

Magnetic flux is excluded from a superconductor. Accordingly, a tube or conduit of superconducting material can be used to constrain the path of magnetic flux and guide it to a target volume, as shown in FIG. 3*a*. The apparatus needed to maintain the superconducting material below its transition temperature is omitted for clarity; its specific arrangement is not important as long as it maintains the superconducting material at the proper temperature. Upon entrance into the tube, magnetic flux is constrained to remain between the walls of the tube until it exits the open end. Many configurations are possible. Another example is shown in FIG. 3*b*, in which flux is substantially constrained to pass through the flux guides and target volume. A further example is shown in FIG. 3c. Here, the target volume is completely enclosed by a continuation of the tube. Sections of the tube wall may be removed, and replaced in intimate contact with the rest of the tube, to provide access to the target volume. These sections may take the form of a door or hatch. Magnetic flux is positively prevented from escaping the intended path by the sealed tube, preventing interference with surrounding instrumentation or other devices.

It may be advantageous to substantially enclose the magnet within the flux guide to reduce or eliminate flux leakage at the joints between the magnet and the flux guide.

ADVANTAGES

A superconducting, air-core flux guide has the potential for reduced mass, compared to a ferromagnetic flux guide. There is no appreciable magnetic flux leakage from the intended flux path. A more uniform magnetic field can be made to pass through the target volume, due to lack of the fringing effect at the ends of the guide. Finally, there is the potential to conduct flux at densities above the saturation level of ferromagnetic flux guides. Above saturation, ferromagnetic guides do not provide substantial guidance to the flux.

One disadvantage of the superconducting flux guide is the need to cool the flux guide material to cryogenic temperatures. Another disadvantage occurs at the low magnetic flux densities, where the lower permeability of the air-core flux path, compared to a ferromagnetic flux path, means that more ampere-turns are required to produce the same amount of magnetic flux.

ALTERNATIVE MODES

In addition to constraining magnetic flux to a desired path, several other functions are possible.

Figure 4:
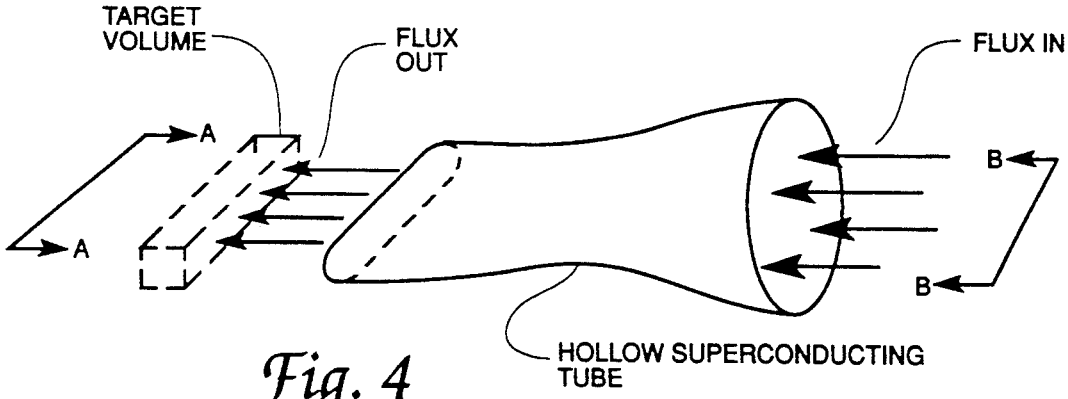
FIGS. 4, 5 and 6 are diagrams showing alternative modes according to the invention of using superconducting guides.
Figure 4A:
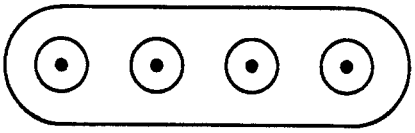
FIGS. 4*a* and 4*b* are sectional views of the device of FIG. 4, taken along lines A—A and B—B respectively.
Figure 4B:
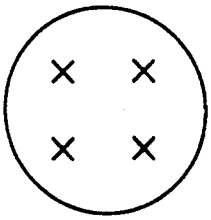

(1) The cross-sectional shape of the superconducting flux guide can be varied to change the shape of the magnetic field through the target volume, as shown in FIG. 4. By a suitable arrangement of the flux guide, both the shape and direction of the flux can be controlled.

Figure 5:
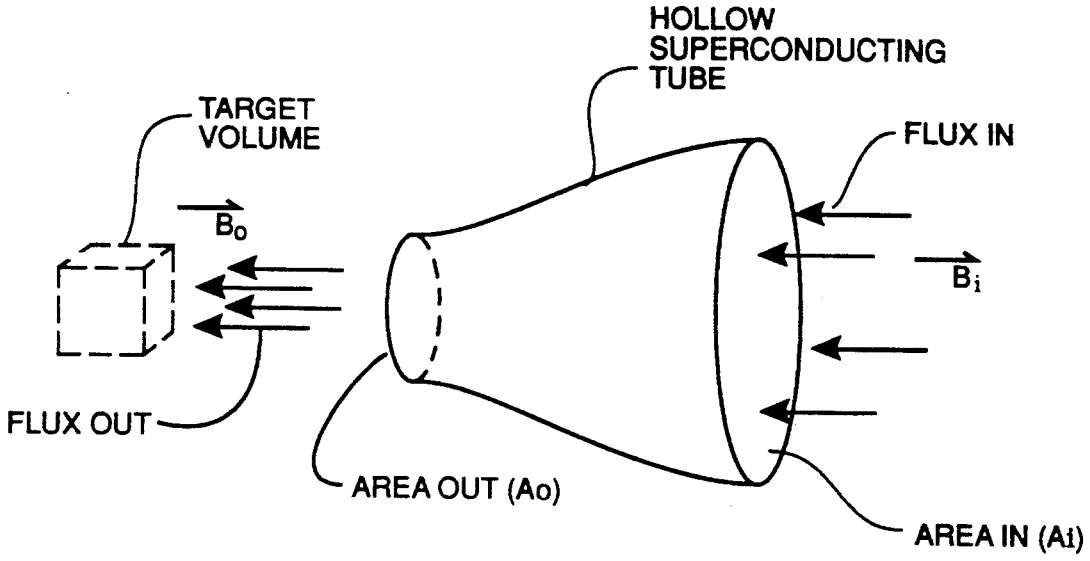

(2) The cross-sectional shape of the flux guide can be reduced or expanded to increase or decrease, respectively, the magnetic flux density in a target volume. See FIG. 5 for an example of flux concentration. Note that this design is not limited to ferromagnetic saturation levels, but rather to the current density capability of the superconducting material used in the guide. Typically this would result in a capability greater than six Tesla.

Figure 6:
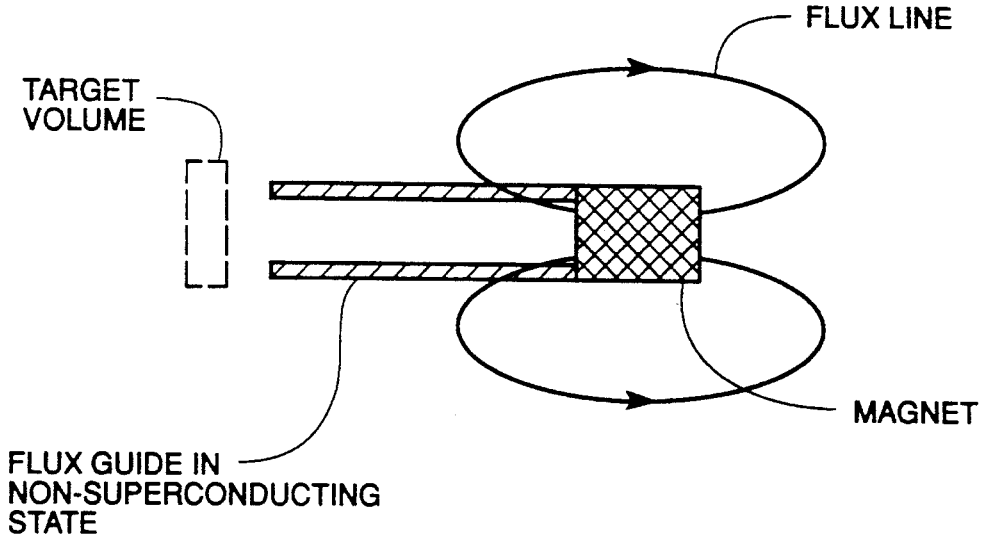

(3) The flux guide can be made to function as a switch. Consider the configuration shown in FIG. 3a. If the flux guide material is suddenly made non-conducting, for example by raising it above its transition temperature, then flux will no longer be constrained by the flux guide and will no longer pass through the target volume. The "off" condition is shown in FIG. 6. (FIG. 3a shows the "on" condition.)

It is understood that certain modifications to the invention as described may be made, as might occur to one with skill in the field of the invention, within the scope of the appended claims. Therefore, all embodiments contemplated hereunder which achieve the objects of the present invention have not been shown in complete detail. Other embodiments may be developed without departing from the scope of the appended claims.

What is claimed is:

1. A superconductive device to guide, shape, contain, or concentrate magnetic flux;

wherein said device is a flux guide comprising a tube having a tube wall made of superconducting material configured to form a closed loop magnetic path to constrain the path of magnetic flux and guide it to a target volume, wherein below a transition point of temperature, current density, and flux density, the material exhibits no resistance to electrical current flow and is impermeable to magnetic flux;

a magnetic flux generator situated within said tube, the target volume being situated within a target section of said tube which is spaced from the magnetic flux generator, said target section having an enlarged superconducting well, and magnetic flux generated by the magnet is confined within said tube and passes through the target volume; and a superconducting hatch located in said enlarged superconducting wall to provide access to the target volume, said hatch being adapted for closing to provide a superconducting member in intimate contact with a remainder of the superconducting wall of the target section.

* * * * *

UNITED STATES PATENT AND TRADEMARK OFFICE

CERTIFICATE OF CORRECTION

PATENT NO. : 5,276,419

DATED : January 4, 1994

INVENTOR(S) : Joseph T. Griffin et al

It is certified that error appears in the above-identified patent and that said Letters Patent is hereby corrected as shown below:

Title page, item [54] "CODE" should be --CORE--.

Column 1, line 1, "CODE" should be --CORE--.

Signed and Sealed this

Eighteenth Day of October, 1994

Bruce Lehman

*Attest:*

BRUCE LEHMAN

*Attesting Officer*

*Commissioner of Patents and Trademarks*